US007510031B2

(12) United States Patent
Russell et al.

(10) Patent No.: US 7,510,031 B2
(45) Date of Patent: Mar. 31, 2009

(54) DIRECTIONAL DRILLING CONTROL

(75) Inventors: Michael King Russell, Cheltenham (GB); Colin Walker, Cheltenham (GB)

(73) Assignee: Russell Oil Exploration Limited, Cheltenham (GB)

( * ) Notice: Subject to any disclaimer, the term of this patent is extended or adjusted under 35 U.S.C. 154(b) by 63 days.

(21) Appl. No.: 11/772,324

(22) Filed: Jul. 2, 2007

(65) Prior Publication Data

US 2008/0121432 A1 May 29, 2008

(30) Foreign Application Priority Data

Jul. 11, 2006 (GB) ..... 0613719.4

(51) Int. Cl.
*E21B 4/20* (2006.01)

(52) U.S. Cl. ..... 175/170; 175/61; 175/320; 175/328

(58) Field of Classification Search ..... 175/61, 175/320, 328, 170, 106, 75
See application file for complete search history.

(56) References Cited

U.S. PATENT DOCUMENTS 3,713,500 A 1/1973 Russell
3,841,420 A 10/1974 Rusell
6,129,160 A * 10/2000 Williams et al. ..... 175/107
6,378,626 B1 * 4/2002 Wallace ..... 175/19
6,536,539 B2 * 3/2003 Merecka et al. ..... 175/62
2004/0238222 A1 * 12/2004 Harrison ..... 175/61
2005/0034895 A1 2/2005 Sawyer
2006/0081399 A1 * 4/2006 Jones ..... 175/61
2006/0240930 A1 * 10/2006 Hicks ..... 475/90
2007/0137897 A1 * 6/2007 Sanders et al. ..... 175/61
2007/0151767 A1 * 7/2007 Downton ..... 175/73

FOREIGN PATENT DOCUMENTS

EP 0763647 12/1998
GB 2435060 8/2007

* cited by examiner

*Primary Examiner*—Jennifer H Gay
*Assistant Examiner*—Daniel P Stephenson
(74) *Attorney, Agent, or Firm*—Martin Fleit; Paul D. Bianco; Fleit Gibbons Gutman Gongini & Bianco PL

(57) ABSTRACT

A down-hole drilling assembly (12, 16) and control system (120) therefor, for directional drilling including a bent housing of a bottom hole assembly (18), utilizing a gearbox (102) to derive a higher speed (about 600 r.p.m.) rotational drive (104) from the drill string (10) to drive a drilling bit (20) via an electromagnetic clutch (110, 112) controlled by the control system (120) such that the clutch balances reaction torque when the orientation angle of the bent housing is correct.

10 Claims, 2 Drawing Sheets

DIRECTIONAL DRILLING CONTROL

FIELD OF THE INVENTION

The invention relates to directional drilling and to means for drilling and for directional control of drilling with a drilling assembly mounted at a lower end of a drill pipe or "string".

BACKGROUND

U.S. Pat. No. 3,713,500 relates to the alteration of the orientation of a drilling assembly by arranging for the drilling head to be rotatable relative to the end of a drill pipe. U.S. Pat. No. 3,841,420 describes means for holding the drilling assembly against the drill rotation torque by the use of a clutch mechanism or a torque balancing force, and to avoid having a conductor wireline in the drilling pipe, the wireline having to be wound up to add a new length of pipe, which is time consuming and also to enable the drill pipe to be rotating whilst drilling to minimise longitudinal friction and to better control weight on the bit. Both these specifications relate to the steering of a drill bit angled relative to the pipe centreline to maintain the angle such that the bit is steered in the desired direction against the tendency of the bit to wander, due to the reaction on the motor body of the motor driving the bit. U.S. Pat. No. 3,841,420 discloses a mud pressure operated hydraulic clutch and electrical operation thereof by a relay controlled by a measuring unit.

SUMMARY OF THE INVENTION

The present invention comprises a drilling assembly for attachment to the lower end of a drill pipe, for directional drilling in a bore hole, wherein the rotational orientation of the drilling head determines the deviation angle of the bore hole, comprising means for attachment of the drilling assembly to said lower end of a drill pipe, a bearing by means of which said drilling assembly is in use rotatably carried by said drill pipe allowing relative rotation of said drilling assembly relative to said drill pipe a bit-driving motor mounted in said drilling assembly and a drilling bit coupled to the motor to be driven thereby so that when said drilling bit is loaded in use said drilling assembly is subjected to a motor reaction torque tending to rotate drilling assembly to change the orientation thereof a slippable clutch device linking the drill pipe to said drilling assembly such that torque due to the rotation of said drill pipe can be controllably applied to said drilling assembly by at least partial engagement of said clutch, and control means operable to sense an actual orientation angle of said drilling assembly and compare said actual orientation angle with a required orientation angle adjustably set in said control means and to control said slippable clutch such that when the actual orientation angle and the required orientational angle are the same the slip torque of the slipping clutch equals the motor reaction torque, so maintaining the orientation angle of the drilling assembly at said required orientation angle, said slippable clutch device comprising a gearbox and an electromagnetic device driven by the drill pipe via said gearbox to increase the rotational speed of the input to said electromagnetic device, said electromagnetic device comprising a fixed winding multipole stator and rotating outer rotor, the degree of relative motion between the stator and rotor being controlled by said control means, giving the necessary degree of slip, the outer rotor being connected to the high-speed output of the gearbox and the stator being connected to the bent housing, mud motor and bottom hole assembly.

The rotating outer rotor may be either a hysteresis or eddy current rotor.

Electrical energy for said control means may be provided by batteries in said drilling assembly.

Desirably the control means for determining the actual orientation angle includes fluxgates and accelerometers.

The rotational speed of the input to the electromagnetic device is desirably at least several hundred rpm, ideally about 600 rpm, this being achieved from the rotational speed of the drill pipe, typically 60 rpm through the gearbox increasing the rotated velocity by about 10:1. The increased rotational speed has the advantage that it is much more useful for power generation.

The gearbox output may be used to drive any combination of generator and electromagnetic torque drive.

The generator preferably comprises a multipole permanent magnet outer rotor with a fixed winding multipole stator.

The invention provides in another aspect a directional drilling control system for down-hole drilling comprising a step-up gearbox having input connection means for connection to and driving co-operation with a rotatable drill pipe, an electromagnetic clutch device having a rotor connected to and driven by the output (high speed) side of the step-up gearbox and having a stator connected to the bent housing of a bottom hole assembly.

Desirably the electromagnetic torque device and a generator are combined into a single unit, the generator and electromagnetic motor torque rotor being connected for driving by the output side of the gearbox, and the generator stator and electromagnetic torque device stator being connected to said bent housing.

The invention will now be described by way of example only and with reference to the accompanying drawings in which:

DETAILED DESCRIPTION

Figure 1:
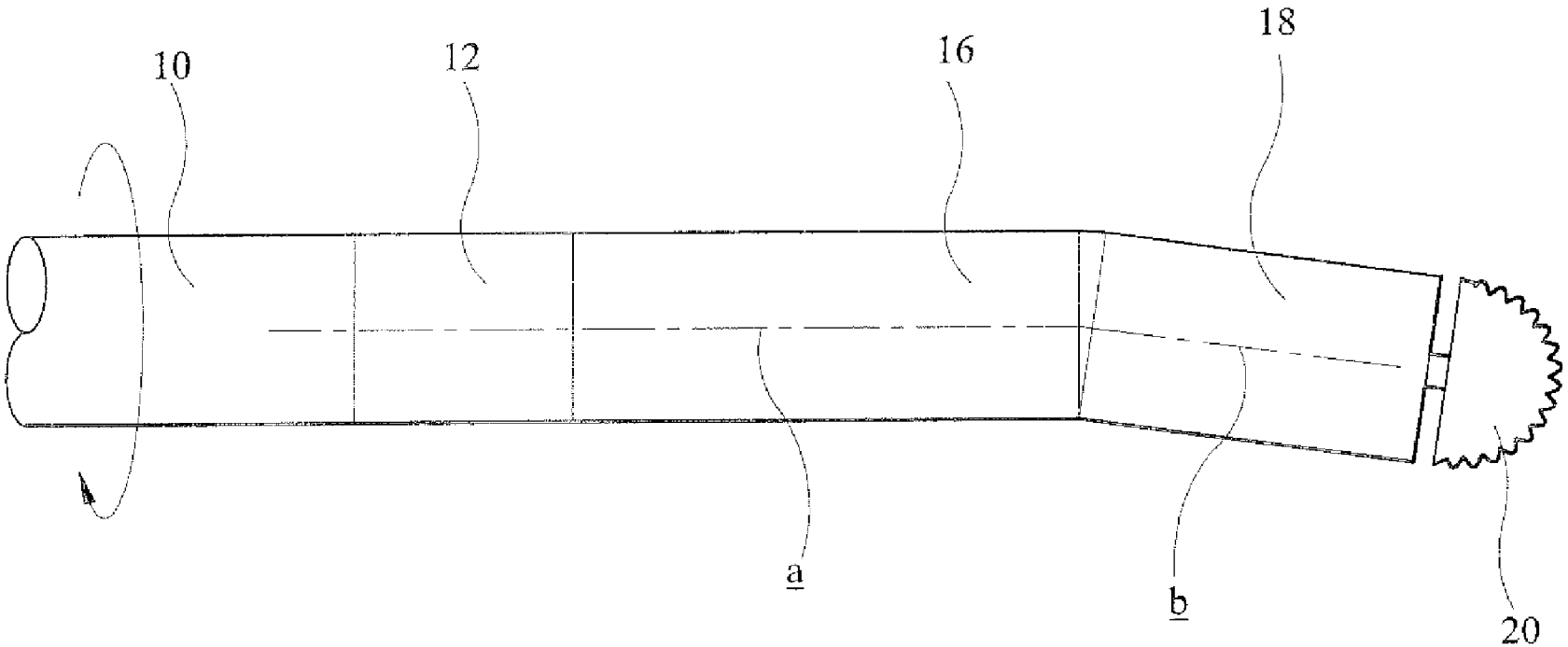
FIG. 1 is a schematic diagram showing a general arrangement of drilling means according to the invention.

In FIG. 1 there is provided a drill pipe shown partially as 10 and mounted for rotation thereon is a slippable clutch device 12 forming part of a drilling assembly which also comprises control means 16 and a bent housing including an hydraulic (mud) motor which drives the drill bit 20. It will be noted that the longitudinal axis b of the bent housing and the axis of rotation of the drilling tool 20 is angled relative to the longitudinal axis a of the drilling head and drill pipe. This follows known constructions in which the angle is used to determine the direction of deviation of the bore hold.

Rotation of the drill bit 20 causes a reaction on the housing 18 which tends to rotate the drilling head around the axis a tending to alter the angular orientation at which the drill bit 20 is working. The slipping clutch device 12 isolates the rotation of the drill pipe 10 (typically 60 rpm) from the drilling head in normal circumstances. The tendency of the drilling bit to wander is caused by the reaction torque of the drill bit on the motor in the bent housing 18. This has to be counteracted by a compensating torque which is derived from the rotation of the drill pipe 10 by allowing partial slippage of the clutch 12. The control means 16 includes fluxgates and accelerometers to sense the actual orientation of the drill bit 20 and compares this with a required orientation angle set in the control means in 16. If the two differ then this triggers means of controlling the slippable clutch 12 in order to provide transmission of extra torque from the drill pipe 10 to the drilling assembly in order to compensate. In the position where the drilling assembly is at the required orientation angle then the difference between the required orientation angle and the actual orientation angle is zero and in this position the slip torque transmitted by the slipping clutch equals the motor reaction torque. This is the "normal" position. Any deviation from this position will result in a difference signal being generated by the control means 16 which will act on the slipping clutch to allow for a compensating torque change so that the slip torque will differ from the motor reaction torque. It will then try to re-establish the correct orientation angle of the drilling head and when this occurs the difference signal will disappear and the normal position will resume.

Figure 2:
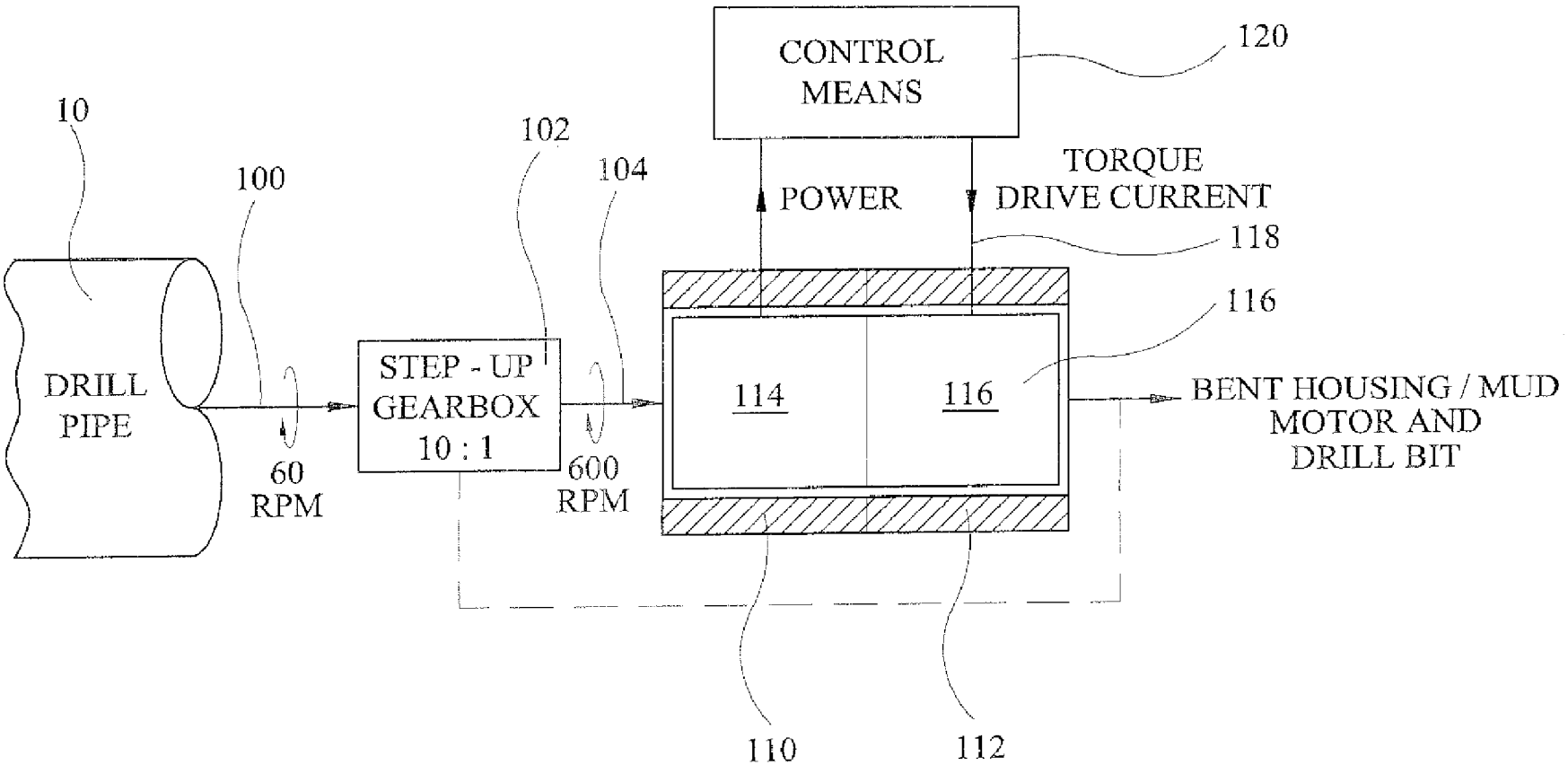
FIG. 2 is a schematic diagram of an assembly comprising a slippable clutch, generator and control means forming part of the drilling means of the invention.

The assembly shown in FIG. 2 corresponds with modules 12 and 16 of FIG. 1. The input 100 of a step-up gearbox 102 is connected to and driven by the rotation of the drill pipe 10 (FIG. 1), the casing of the step-up gearbox being secured to the bent housing. The output 104 of the step-up gearbox 10 is connected to and drives a combined rotor comprising a generator rotor 10 and an electromechanical torque drive motor 112 which are driven in unison by the output 104. Received within the generator rotor 110 is the generator stator 114 which rotates in unison with an electromagnetic torque drive rotor stator 116 which rotates with the rotor 112. The stators 114 and 116 are connected to the bent housing 18 (FIG. 1).T*he* torque drive motor 112 and electromagnetic torque drive rotor stator 116 constitute a hysteresis or drag cup brake.

Control means 120 are provided which receive power from the generator (110, 114) and compares the sensed orientation angle with the required pre-set orientation angle to give a difference signal. If the difference signal is non-zero the control means controls drive current via connection 118 to the electromagnetic torque drive to transmit more torque until the difference signal is zero.

The torque required at the gearbox output is reduced by at least the gear ratio and (because the generator power density is proportional to the square of speed) a useful amount of power is generated for use in a hysteresis or drag cup brake (112 and 116 of FIG. 3). This enables a practical implementation of the controllable clutch at an input drillpipe rate of 60 rpm.

The invention claimed is:

1. A drilling assembly for attachment to the lower end of a drill pipe, for directional drilling in a bore hole, wherein the rotational orientation of the drilling head determines the deviation angle of the bore hole, comprising means for attachment of the drilling assembly to said lower end of a drill pipe, a bearing by means of which said drilling assembly is in use rotatably carried by said drill pipe allowing relative rotation of said drilling assembly relative to said drill pipe, a bit-driving motor mounted in said drilling assembly and a drilling bit coupled to the motor to be driven thereby so that when said drilling bit is loaded in use said drilling assembly is subjected to a motor reaction torque tending to rotate drilling assembly to change the orientation thereof, a shippable clutch device linking the drill pipe to said drilling assembly such that torque due to the rotation of said drill pipe can be controllably applied to said drilling assembly by at least partial engagement of said clutch, and control means operable to sense an actual orientation angle of said drilling assembly and compare said actual orientation angle with a required orientation angle adjustably set in said control means and to control said slippable clutch such that when the actual orientation angle and the required orientational angle are the same the slip torque of the slipping clutch equals the motor reaction torque, so maintaining the orientation angle of the drilling assembly at said required orientation angle, said slippable clutch device comprising a gearbox and an electromagnetic torque device driven by the drill pipe via said gearbox to increase the rotational speed of the input to said electromagnetic torque device, said electromagnetic torque device comprising a fixed winding multipole stator and rotating outer rotor, the degree of relative motion between the stator and rotor being controlled by said control means, giving the necessary degree of slip, the outer rotor being connected to the high-speed output of the gearbox and the stator being connected to the bent housing, mud motor and bottom hole assembly.

2. A drilling assembly as claimed in claim 1 in which the rotating outer rotor is an hysteresis rotor.

3. A drilling assembly as claimed in claim 1 in which the rotating outer rotor is an eddy-current rotor.

4. A drilling assembly as claimed in claim 1 in which there is provided a battery to provide electrical energy for said control means.

5. A drilling assembly as claimed in claim 1 in which the control means for determining the actual orientation angle includes fluxgates and accelerometers.

6. A drilling assembly as claimed in claim 1 in which the rotational speed of the input to the electromagnetic device is desirably at least several hundred revolutions per minute (rpm).

7. A drilling assembly as claimed in claim 1 in which the rotational speed of the input to the electromagnetic device is ideally about 600 rpm, this being achieved from the rotational speed of the drill pipe, typically 60 rpm through the gearbox increasing the rotated velocity by about 10:1.

8. A drilling assembly as claimed in claim 1 in which there is provided a generator comprising a multipole permanent magnet outer rotor with a fixed winding multipole stator.

9. A drilling assembly as claimed in claim 8 in which the electromagnetic torque device and a generator are combined into a single unit, the generator and electromagnetic motor torque rotor being connected for driving by the output side of the gearbox, and the generator stator and electromagnetic torque device stator being connected to and driving said bent housing.

10. A directional drilling control system for down-hole drilling comprising a step-up gearbox having input connection means for connection to and driving co-operation with a rotatable drill pipe, an electromagnetic clutch device having a rotor connected to and driven by the output (high speed) side of the step-up gearbox and having a stator with connection means for connection with a bent housing of a hole bottom assembly, to drive said bent housing.

* * * * *